US007280798B2

(12) United States Patent
Yuminamochi

(10) Patent No.: US 7,280,798 B2
(45) Date of Patent: Oct. 9, 2007

(54) IMAGE FORMING APPARATUS WITH CONVEYING DEVICE URGING A RECORDING MATERIAL TOWARD A CHARGE ELIMINATING MEMBER

(75) Inventor: Takayasu Yuminamochi, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 267 days.

(21) Appl. No.: 11/071,320

(22) Filed: Mar. 4, 2005

(65) Prior Publication Data

US 2005/0201789 A1 Sep. 15, 2005

(30) Foreign Application Priority Data

Mar. 9, 2004 (JP) ..... 2004-065878

(51) Int. Cl.
*G03G 15/00* (2006.01)
*G03G 15/14* (2006.01)

(52) U.S. Cl. ..... 399/390; 399/367; 399/316; 399/388; 399/406; 399/396; 399/315; 399/310; 399/354; 271/18.1; 271/208

(58) Field of Classification Search ..... 399/367, 399/390, 316, 388, 406, 396, 315, 310, 354; 271/18.1, 208
See application file for complete search history.

(56) References Cited

U.S. PATENT DOCUMENTS 4,055,380 A * 10/1977 Borostyan ..... 399/316
5,136,342 A * 8/1992 Ida et al. ..... 399/396
5,153,654 A 10/1992 Yuminamochi et al. ..... 355/277
5,177,549 A 1/1993 Ohtsuka et al. ..... 355/284
5,223,900 A 6/1993 Yuminamochi et al. ..... 355/273
5,428,431 A * 6/1995 Abe et al. ..... 399/396
5,682,576 A 10/1997 Sakai et al. ..... 399/69
5,812,923 A * 9/1998 Yamauchi et al. ..... 399/388
5,926,683 A * 7/1999 Yuminamochi et al. ..... 399/398
6,005,594 A 12/1999 Nanataki et al. ..... 347/156
6,167,230 A * 12/2000 Kimura et al. ..... 399/315
6,347,211 B2 2/2002 Nanataki et al. ..... 399/328
6,438,348 B2 8/2002 Kobaru et al. ..... 399/333
6,493,534 B2 * 12/2002 Sawanaka et al. ..... 399/316
6,496,661 B2 12/2002 Ando et al. ..... 399/22
6,516,179 B1 * 2/2003 Sawai et al. ..... 399/388
6,587,662 B2 7/2003 Kobaru et al. ..... 399/323

(Continued)

FOREIGN PATENT DOCUMENTS

JP 58-75166 5/1983

(Continued)

*Primary Examiner*—Ren Yan
*Assistant Examiner*—Matthew Marini
(74) *Attorney, Agent, or Firm*—Fitzpatrick, Cella, Harper & Scinto

(57) ABSTRACT

The image forming apparatus has an image bearing member for bearing a toner, a transfer device which forms a transfer area in cooperation with the image bearing member for transferring the toner on the image bearing member onto a recording material, a charge elimination device which is opposed to the recording material at an upstream side of the transfer area in a conveying direction of the recording material thereby eliminating a charge on the recording material, and a control device which controls the recording material so as to form a loop in a position opposed to the charge elimination device, wherein the recording material forms a loop by the control device thereby approaching to the charge elimination device.

28 Claims, 7 Drawing Sheets

U.S. PATENT DOCUMENTS

| | | | | |
|---|---|---|---|---|
| 6,970,676 | B2 | 11/2005 | Ito et al. | 399/315 |
| 2001/0033760 | A1* | 10/2001 | Sawanaka et al. | 399/316 |
| 2002/0146261 | A1* | 10/2002 | Kanari et al. | 399/388 |
| 2004/0170453 | A1* | 9/2004 | Ito et al. | 399/315 |
| 2005/0201789 | A1 | 9/2005 | Yuminamochi | 399/390 |
| 2005/0276637 | A1* | 12/2005 | Koike et al. | 399/313 |

FOREIGN PATENT DOCUMENTS

| | | |
|---|---|---|
| JP | 59-26751 | 2/1984 |
| JP | 3-154088 | 7/1991 |
| JP | 6-51647 | 2/1994 |
| JP | 6-149074 | 5/1994 |
| JP | 11-305511 | 11/1999 |
| JP | 2000-293066 | 10/2000 |
| JP | 2001-255754 | 9/2001 |
| JP | 2004-184919 | 7/2004 |

* cited by examiner

IMAGE FORMING APPARATUS WITH CONVEYING DEVICE URGING A RECORDING MATERIAL TOWARD A CHARGE ELIMINATING MEMBER

BACKGROUND OF THE INVENTION

1. Field of the Invention

The present invention relates to an image forming apparatus utilizing an electrophotographic technology, and more particularly to a charge elimination of a recording material.

2. Description of the Related Art

A configuration of a prior image forming apparatus is shown in FIG. 7.

A prior image forming apparatus is provided with a photosensitive drum 101 serving as an image bearing member. The photosensitive drum 101 is shaped in a cylindrical form, and is supported rotatably in a direction R1 indicated by an arrow, in a main body (not shown) of the apparatus. Along a periphery and a rotating direction of the photosensitive drum 101, there are provided, for example, a charging apparatus 102 for uniformly charging the photosensitive drum 101, an exposure apparatus 103 for emitting a laser beam corresponding to a document image (the image of an original) for exposing the photosensitive drum 101 thereby forming an electrostatic latent image, a developing apparatus 105 for depositing a toner onto the electrostatic latent image thereby forming a toner image, a transfer roller 106 constituting a transfer member which transfer the toner image on the photosensitive drum 101 onto a paper P, and a cleaner 107 for eliminating a residual toner remaining on the photosensitive drum 101 after the transfer.

On the other hand, in an upstream side of the photosensitive drum 101 in a conveying direction (namely at the right-hand side in FIG. 7), there is mounted a sheet cassette 109 for stacking papers P to be used for image formation. A sheet feeding roller 110 is provided at an upper front side of the sheet cassette 109, and a transfer material conveying path 111 is provided at a downstream side thereof (left side in FIG. 7). In the transfer material conveying path 111, there are provided two pairs of conveying rollers 112 for conveying the paper P by nipping both sides thereof, a registration sensor 113 for detecting a leading edge of the paper P, and a charge elimination brush 115 constituting a charge elimination member which eliminates a charge on the paper P by a contact therewith. Also a pre-transfer guide 116 is provided as a part of the transfer material conveying path 111, for guiding the paper P to a transfer area. At a downstream side of the photosensitive drum 101, there is provided a fixing apparatus (not shown) for fixing a toner image transferred onto the paper P.

When a print signal is inputted from an unillustrated host computer to the image forming apparatus, the photosensitive drum 101 starts to rotate in a direction R1 as illustrated and is subjected to a uniform surface charging by the charging apparatus 102. At this operation, the sheet feeding roller 110 is rotated to feed the paper 9 from the sheet cassette 109. The fed paper 9 is pinched and conveyed by the conveying rollers 112, and is stopped upon reaching a position of putting down the sensor 113. On the other hand, the charged surface of the photosensitive drum 101 is irradiated with a laser beam modulated by an image signal, whereby an electrostatic latent image is formed. Then, on the electrostatic latent image, a toner is deposited by a developing roller 105*a* of the development apparatus 105 thereby forming a toner image. In synchronization with such toner image, the conveying rollers 112 are driven, and the paper P comes into contact with the charge eliminating brush 115 for a charge elimination on a rear side thereof, then enters a transfer area through the pre-transfer guide 116, and receives a transfer of the toner image on the photosensitive drum 101, by a transfer roller (transfer apparatus) to which a transfer bias is supplied from an unillustrated high voltage source. The paper P is subsequently subjected to a fixation of the toner image by an unillustrated fixing apparatus, and is discharged from the main body of the apparatus. On the other hand, the photosensitive drum 101, from which the toner image has been transferred, is subjected to an elimination of a residual toner by the cleaner 107, thus being prepared for a next image forming process, which is to be started by a charging by the charging apparatus 102.

In such prior technology, however, the leading end of the paper P may be caught by the charge eliminating brush 115 thereby causing a paper jam. When a thin paper P contact the charge eliminating brush 115, a leading end portion may be bent thereby leading to a paper jamming.

The charge eliminating brush 115, constituting a charge elimination member in FIG. 7, is so positioned as to intercept the path of the paper, in order to improve the charge eliminating effect for the paper P. However, such positioning of the charge elimination member as to intercept the path of the paper may cause a case where the leading end of the paper is caught by the charge eliminating members, and a paper jamming may be generated from the position of such catching.

SUMMARY OF THE INVENTION

The present invention has been made in consideration of the foregoing drawbacks and an object of the present invention is to achieve an efficient charge eliminating effect for a recording material.

A further of the present invention is to provide an image forming apparatus including:

an image bearing member for bearing a toner;

a transfer member which forms a transfer area in cooperation with the image bearing member for transferring the toner on the image bearing member onto a recording material;

a charge elimination member which is opposed to the recording material at an upstream side of the transfer area in a conveying direction of the recording material thereby eliminating a charge on the recording material; and a controller which controls the recording material so as to form a loop in a position opposed to the charge elimination member;

wherein the recording material forms a loop by the controller thereby approaching to the charge elimination member.

A further object of the present invention is to provide an image forming apparatus including:

an image bearing member for bearing a toner;

a transfer member which transfers the toner on the image bearing member onto a recording material;

a charge elimination member which is opposed to the recording material at an upstream side of the transfer member in a conveying direction of the recording material thereby eliminating a charge on the recording material;

a first recording material conveying member which conveys the recording material; and a second recording material conveying member which conveys the recording material;

wherein the first recording material conveying member and the second recording material conveying member are provided in a mutually adjacent relationship in a conveying path of the recording material, also the first recording material conveying member is positioned more upstream of the second recording material conveying member in the conveying path of the recording material, the recording material comes into an opposed relationship to the charge elimination member between the first recording material conveying member and the second recording material conveying member, and a conveying speed for the recording material is larger in the first recording material conveying member than in the second recording material conveying member.

A further object of the present invention is to provide an image forming apparatus including:

an image bearing member for bearing a toner;

a transfer member which forms a transfer nip in cooperation with the image bearing member for transferring the toner on the image bearing member onto a recording material;

a charge elimination member which is opposed to the recording material at an upstream side of the transfer nip in a conveying direction of the recording material thereby eliminating a charge on the recording material; and a recording material conveying member which conveys the recording material;

wherein the recording material conveying member is positioned closest to the transfer nip, in a conveying path of the recording material, among members serving to convey the recording material, while the image bearing member forms a transfer nip in a transfer area in cooperation with the transfer member, the recording material comes into an opposed relationship to the charge elimination member between the recording material conveying member and the transfer nip, and a conveying speed for the recording material is larger in the recording material conveying member than in the transfer nip.

A further object of the present invention is to provide an image forming apparatus including:

an image bearing member for bearing a toner;

a transfer member which forms a transfer area in cooperation with the image bearing member for transferring the toner on the image bearing member onto a recording material; and a sheet-shaped charge elimination member which is opposed to the recording material, at a surface thereof for receiving the transfer of the toner, at an upstream side of the transfer area in a conveying direction of the recording material thereby eliminating a charge on the recording material.

A still further objects of the present invention will be become fully apparent from the following detailed description.

DETAILED DESCRIPTION OF THE PREFERRED EMBODIMENTS

In the following, an image forming apparatus of the present invention will be explained in detail, with reference to the accompanying drawings.

First Embodiment

Figure 1:
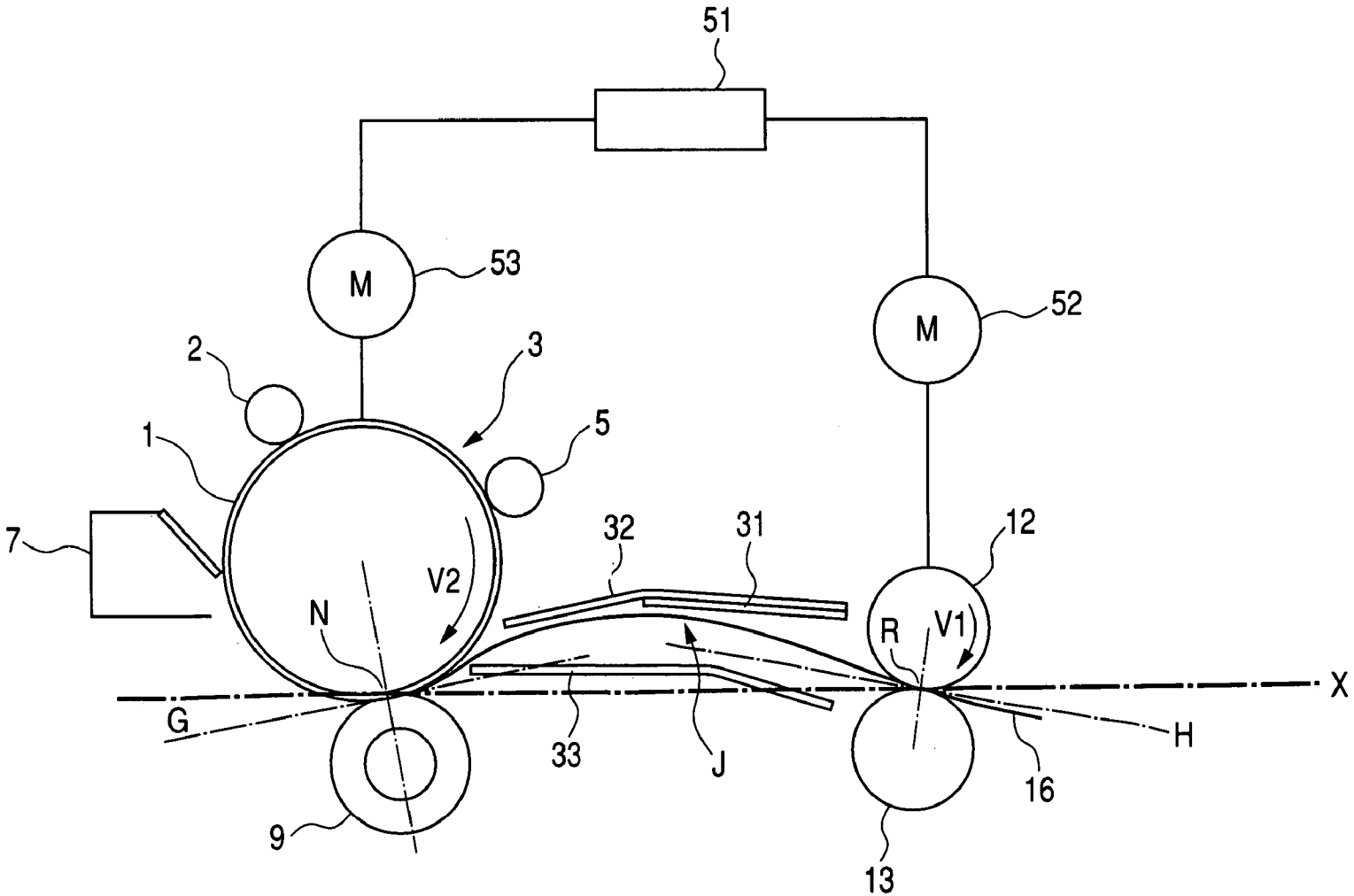
FIG. 1 is a view showing a configuration around a transfer apparatus in a first embodiment of the present invention.

FIG. 1 illustrates a first embodiment of the present invention, wherein shown are a photosensitive drum 1 constituting an image bearing member; a transfer roller 9 constituting a transfer member; an upper registration roller 12; a lower registration roller 13; an upper guide 32 for limiting a conveying direction of the recording material in front of a transfer area; and a lower guide 33 for limiting a conveying direction of the recording material in front of the transfer area. The upper registration roller 12 and the lower registration roller 13 form a nip thereby functioning as a recording material conveying member. In FIG. 1, a line G is tangential to an external periphery of the photosensitive drum 1 and perpendicular to a line passing the centers of the photosensitive drum 1 and the transfer roller 9. Also a line H is perpendicular to a line passing the centers of the upper registration roller 12 and the lower registration roller 13 and tangential to the external periphery of the upper registration roller 12.

J indicates a sheet conveying path after a leading end of a sheet is pinched by a transfer nip N in the transfer area. V2 indicates an external peripheral velocity of the photosensitive drum 1, and V1 indicates an external peripheral velocity of the paired registration rollers 12, 13. In FIG. 1, a neutralizing cloth 31, constituting a charge elimination member, is formed by coating an electroconductive paint, prepared by dispersing carbon in an acrylic resin binder, on a non-woven cloth of polyethylene terephthalate fibers, and is adhered to the upper guide 12 with an electroconductive double-sided adhesive tape. The neutralizing cloth has a surface resistance of $10^4$-$10^6$ Ω.

The photosensitive drum 1 has an external diameter of 30 mm and a length of 280 mm, thus capable of printing on a paper of a letter size with a width of 216 mm. It is formed by coating an aluminum pipe of a thickness of 1 mm with a polycarbonate-based organic photosensitive material.

A surface of the photosensitive member 1 is subjected to a charging and an exposure by charging device 2 and exposure device 3, thereby forming an electrostatic latent image with a dark potential of −700 V and a light potential of −150 V. The electrostatic latent image is developed by developing device 5 into a toner image. Toner (developer) is produced by a crashing process and has an average particle size of 7 μm. The toner is negatively charged with a charge amount of about 7 μc/g.

In case of printing a solid image, a toner amount carried on the photosensitive drum is about 1.0 to 1.5 mg/cm$^2$. The photosensitive drum has a peripheral velocity of 200 mm/sec on the external periphery. At the image formation, a control apparatus 51 executes a rotation control on a driving motor 53 to rotate the photosensitive drum with a peripheral velocity V2, whereby a paper pinched in the nip formed with the transfer roller 9 is also conveyed with a speed V2. Such peripheral velocity is realized by rotating the photosensitive drum of an external diameter of 30 mm with a revolution 127.32 rpm.

The transfer roller 9 has an external diameter of 17 mm and a metal core diameter of 8 mm. An elastic layer is constituted of a mixture of NBR and an epichlorohydrin rubber, molded under foaming. The elastic layer has an electrical resistance of about $10^6$-$10^9$ Ωcm. A surface of the transfer roller has a hardness of 28° when an Asker-C hardness meter is pressed thereto under a pressure of 500 gf.

The toner image carried on the photosensitive drum 1 is transferred onto the paper, serving as a recording material, is executed by applying a bias voltage to the metal core of the transfer roller. An applied voltage is within a range of +1 to +6 kV.

The upper registration roller 12 is constituted of nickel-plated iron with an external diameter of 14 mm, and the lower registration roller 13 is formed by an iron metal core of an external diameter of 10 mm covered by chloroprene rubber of a thickness of 2 mm, with an external diameter of 14 mm. The metal cores of the upper registration roller 12 and the lower registration roller 13 are electrically grounded. The chloroprene rubber of the lower registration roller is electrically insulating. A residual toner after the transfer is recovered by a cleaning apparatus 7.

The transfer nip N and a nip R of the paired registration rollers is separated by a distance of 45 mm.

The upper guide 32 and the lower guide 33 are formed by zinc-coated steel plates, formed by subjecting an iron metal plate to a zinc plating and a chromate treatment. The upper guide 32 and the lower guide 33 are both electrically grounded. The neutralizing cloth 31 is formed by a charge eliminating tape #7784 manufactured by Okamoto Co. The zinc-coated steel plate has a surface resistance of 0.46 MΩ when measured with probes of a Multi-meter 89IV, manufactured by Fluke Inc., contacted with a gap of 10 mm.

The neutralizing cloth 31 is adhered to the upper guide, thereby being so arranged as to be capable of a charge elimination from a surface of the recording material, receiving the toner transfer in the transfer area. Such arrangement is adopted because a charge elimination preferentially of the toner carrying surface of the recording material is more effective against toner scattering phenomenon and the like, though such effect is variable depending on a resistance and a thickness of the recording material. Also a neutralizing cloth, constituting a sheet-shaped charge elimination member, is adopted because it is less likely to cause a catching when it is contacted with the recording material, in comparison with a charge eliminating needle or a charge eliminating brush. Also a neutralizing cloth has more points capable of causing discharges, in comparison with a charge eliminating needle, so that the charge eliminating ability is less likely to be lowered even when the charge elimination member is somewhat deteriorated.

A direction of the transfer nip N and the nip R, namely a paper conveying direction by the nips, is provided in the following manner, with respect to a reference line X connecting the transfer nip N and the nip R, namely a line connecting the center points of the nips. A center of the transfer roller 9 is displaced in the vertical direction from a center of the photosensitive drum 1 in such a manner that a line G corresponding to a nipping line of the transfer nip N and the reference line X form an angle of 20° and that the line G is positioned higher between the transfer nip N and the nip R. On the other hand, in the paired registration rollers, a line H corresponding to a nipping line of the nip R and the reference line X form an angle of 15° and that, between the transfer nip N and the nip R, the line H is positioned higher or at a side where the neutralizing cloth 31 is present.

The lower guide 33 is positioned higher than a line (reference line X) connecting the transfer nip N and the nip R of the paired registration rollers. The neutralizing cloth 31 is adhered on a surface of the upper guide 32, at a side where the paper passes. A paper emerging from the paired registration rollers is conveyed along the line H, and the transfer guide is so constructed that the line H does not pass the area where the neutralizing cloth 31 is adhered. The neutralizing cloth 31 and the line H are separated by a distance of 0.5 mm or larger. In case of passing a curled paper, as in an apparatus for executing a two-side printing, such distance is selected as 1.5 mm or larger.

In the present embodiment, the neutralizing cloth is closest, at an end thereof closer to the photosensitive drum, to the line H, and the both are separated by a gap of 1.0 mm in such end portion. The aforementioned gap between the neutralizing cloth 31 and the line H allows to prevent a sheet jamming caused by a hooking of the leading end of the paper by the neutralizing cloth.

In the following, there will be explained a paper conveying operation in the present embodiment. When an image formation is initiated on the photosensitive drum 1 by an unillustrated image formation apparatus, a paper 16 is conveyed toward the photosensitive drum 1 in synchronization with the toner image on the photosensitive drum 1. Then, under a control by the control apparatus 51 serving as the controller, the driving motor 52 is energized to rotate the paired registration rollers with a peripheral velocity VI of 204 mm/sec which is 2% higher than the peripheral velocity of the photosensitive drum 1, whereby the paper pinched by the paired registration rollers is conveyed with a velocity of 204 mm/sec. The paper 16 is conveyed along a trajectory tangential to the line H, and becomes opposed to the neutralizing cloth 31. The paper 16, when the leading end thereof enters the transfer nip N, is conveyed by both the transfer nip N and the registration nip R, and, because of a difference in the conveying velocities thereof by 2%, a loop in the paper grows in the course of conveying. At a moment when the leading end of the paper is nipped in or contacted with the transfer nip N, since the paper conveying direction by the nip R is positioned above the reference line X, a loop convex to the above is formed by the rigidity of the paper. Also such loop convex to the above is secured by a fact that the lower guide 33 is positioned higher than the transfer nip N. Also in the present embodiment, an edge height of the upper guide 32 from the photosensitive drum 1 is so selected that a loop amount (loop height) formed by the lower guide 33 becomes 2.0 mm. The amount of loop increases with the conveying operation of the paper. The loop amount further increases by about 0.5 mm when the paper is conveyed by about 10 mm by the transfer nip N, whereupon the distance between the neutralizing cloth 31 and the paper is reduced to about 1.5 mm, thereby increasing the charge eliminating effect by the neutralizing cloth 31. Thereafter, the loop grows gradually to reach a state where the paper 16 is conveyed in contact with the neutralizing cloth 31. A stabler charge elimination can be achieved by such contact of the paper with the neutralizing cloth.

In case of an image formation with a paper that has been let to stand in an environment of an air temperature of about 15° C. and a humidity of about 10%, the paper is charged positively by a contact with resinous components such as the sheet feeding roller. An amount of charging is variable depending on a condition of friction with the resinous component, environmental conditions and the type of paper, but a paper of a basis weight of 64 g/$m^2$ is charged to about +5 kV when it is conveyed in contact with a chloroprene rubber under a planar pressure of about 1 kgf/cm$^2$ (when measured with a potential meter model 341, manufactured by Torek Co., in a suspended state in the air without a rear electrode). Such charging of paper induces a transfer of the toner image of the photosensitive drum in front of the transfer nip N, and such transfer, being conducted in a state where the paper and the photosensitive drum are not contacted, provides a blurred image. Such phenomenon is called a toner scatter. The potential of the paper should be reduced to +1.5 kV in order to prevent such scatter to a certain extent, and preferably reduced to +1 kV or less in order that the influence of charging of the paper is scarcely noticeable on the image.

Figure 2:
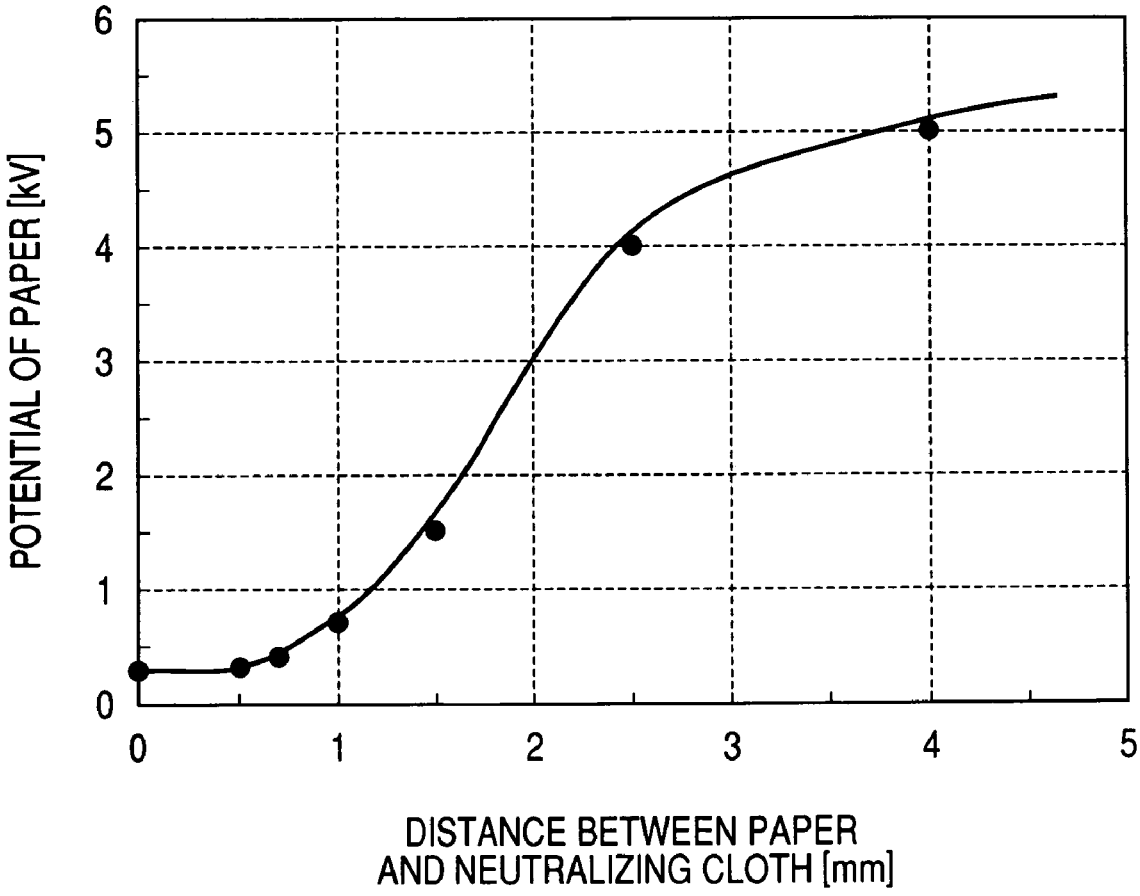
FIG. 2 is a chart showing an experimental result of a configuration of the first embodiment of the present invention.

FIG. 2 shows a relationship between a distance of the neutralizing cloth and a potential on paper, after a paper charged to a potential of +5 kV is passed in the vicinity of the neutralizing cloth 31, wherein the abscissa indicates the distance between the neutralizing cloth 31 and the paper 16, while the ordinate indicates the potential of the paper 16 after passing the vicinity of the neutralizing cloth. A charge eliminating effect is small with a distance of the paper and the neutralizing cloth equal to or larger than 4 mm, but an amount of elimination of the charge of the paper, or a charge eliminating effect, increases with a shorter distance. The paper potential can be reduced to +1.5 kV in case of a distance of 1.5 mm between the paper and the neutralizing cloth, +1 kV in case of a distance of 1.0 mm and +500 V or less in case of a distance of 0.7 mm. In the present embodiment, the charge eliminating effect by the neutralizing cloth starts to appear more evidently on the image at a position where the leading end of the paper is pinched by the transfer nip N and further advances by 10 mm, because the paper develops a loop and becomes positioned closer to the neutralizing cloth. Nevertheless, the charge eliminating effect is exhibited also even in an area of the leading end portion of the paper. It is because the paper is conveyed from the nip R in the direction of the tangential line H as explained before and, in the course of such conveying, the area of the leading end portion of the paper once approaches the neutralizing cloth 31. When the neutralizing cloth 31 is adhered at a position of 15 mm from the transfer nip, the charge eliminating effect starts to be exhibited significantly from a position of 25 mm from the leading end of the paper. After the position of 25 mm, the paper is conveyed in a state close to or in contact with the neutralizing cloth and is therefore conveyed under secure charge elimination. A range of the charge eliminating effect achieved by the paper loop can be regulated by suitably selecting a shape of the guide and an adhering position of the neutralizing cloth. In the present embodiment, the transfer roller and the paired registration rollers are so positioned as to form a loop convex toward the transfer guide on which the neutralizing cloth is adhered, and the lower guide is set at a position higher than a line connecting the transfer nip N and the nip R of the paired registration rollers. Also the peripheral velocity of the registration rollers is selected larger than that of the photosensitive drum, in order that the loop of the paper becomes gradually larger in the course of conveying.

The aforementioned configuration allows to achieve secure charge elimination of the paper thereby preventing an image scattering, while avoiding a paper jamming caused by a leading end portion of the paper being caught by the neutralizing cloth.

Second Embodiment

Figure 3:
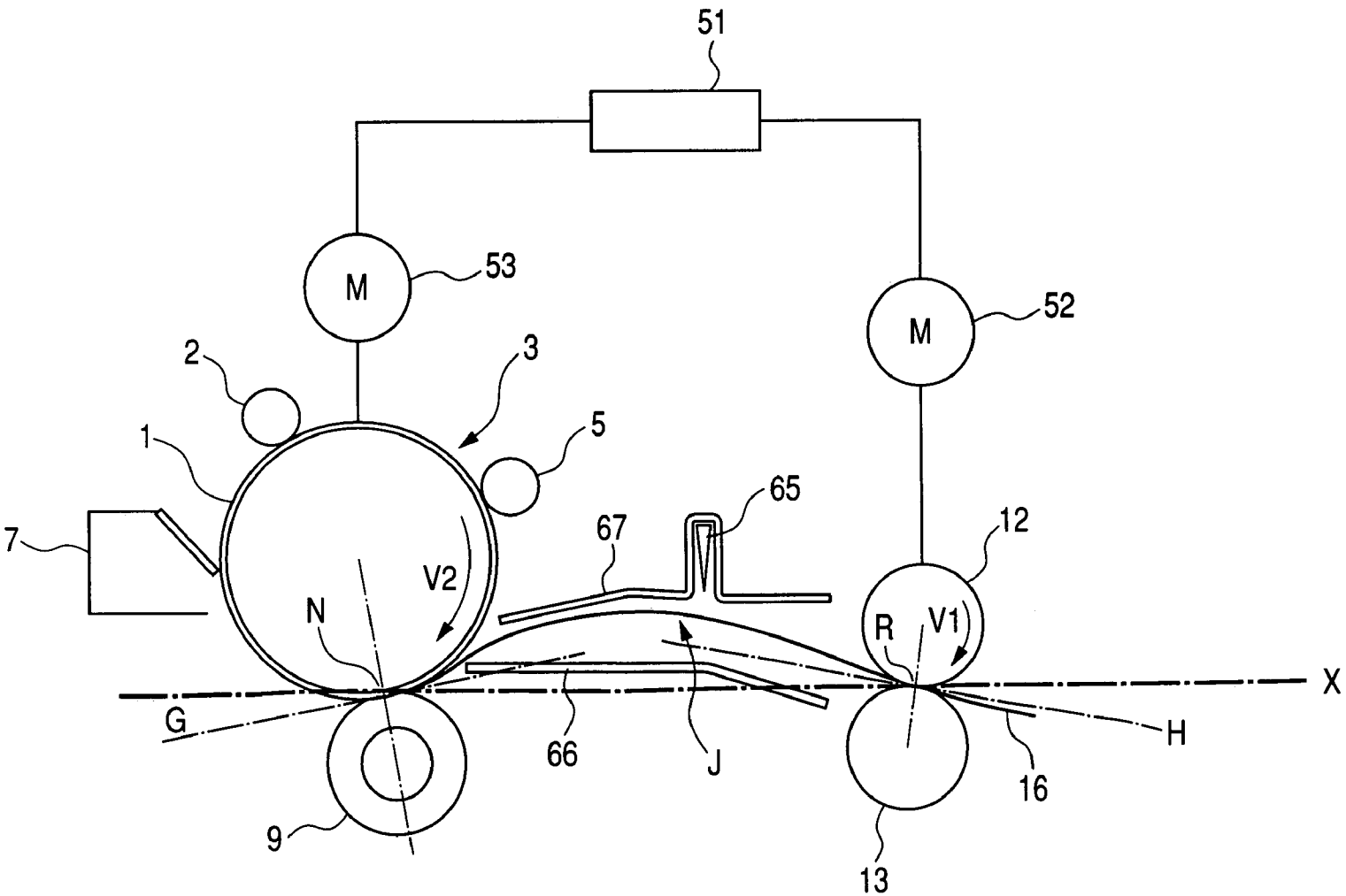
FIG. 3 is a view showing a configuration around a transfer apparatus in a second embodiment of the present invention.

FIG. 3 shows a configuration of a second embodiment of the present invention. As the configuration is approximately same as that of the first embodiment, explanation will be given principally on different components. Components represented by same numbers as the components in the first embodiment have equivalent functions and will not, therefore, be explained again.

In the present embodiment, an upper guide 67 is provided with a recess in which provided a charge eliminating needle 65 constituting a charge elimination member. Paired registration rollers and a transfer roller 9 move in the same manner as in the first embodiment, so that the paper has a conveying path J similar to that in the first embodiment.

An upper guide 67 and a lower guide 66 are both electrically grounded. The charge eliminating needle 65 constituting the charge elimination member is constituted of charge eliminating needles with tips arranged with a pitch of 2 mm. The charge eliminating needles 65 are electrically conductive with the upper guide 67.

As to a direction of the transfer nip N and the nip R, namely a conveying direction of the paper by the nips, the transfer nip N, the nip R and the reference line X have a relationship same as that in the first embodiment.

The lower guide 66 is provided higher than a line connecting the transfer nip N and the nip R of the paired registration rollers. Also the upper guide 67 is provided with the charge eliminating needles 65 in the vicinity of the surface of the passing paper. A paper emerging from the paired registration rollers is conveyed along the line H, and the transfer guide is so constructed that the line H does not pass the area where the charge eliminating needles 65 are provided. The tips of the charge eliminating needles 65 and the line H are separated by a distance of 0.5 mm or larger. In case of passing a curled paper, as in an apparatus for executing a two-side printing, such distance is selected as 1.5 mm or larger.

A spacing between the charge eliminating needles 65 and the line H allows to suppress a paper jamming caused by the leading end of the paper being caught by the charge eliminating needles. The upper guide 67, in a part other than the recess, has a gap of 2.0 mm to the tips of the charge eliminating needles 65. Also the upper guide 67 is provided with a recess in a portion of the charge eliminating needles 65, and a sufficient distance is secured between the line H and the recess in order that the leading end of the paper is not caught in such recess. As a result, the leading end of the paper is not trapped in the recess.

A paper conveying operation of the present embodiment is same as that in the first embodiment except for following points.

The paper 16 is conveyed along a trajectory of the line H, and becomes opposed to the charge eliminating needles 65. As explained in the first embodiment, the paper 16, when a leading end thereof enters the transfer nip N, forms a loop convex toward the charge eliminating needles 65. The amount of loop increases with the conveying operation of the paper. The loop amount further increases by about 0.5 mm when the paper is conveyed by about 10 mm by the transfer nip N, whereupon the distance between the tips of the charge eliminating needles 65 and the paper is reduced to 2.5 mm, thereby increasing the charge eliminating effect by the charge eliminating needles 65.

Thereafter, the loop grows gradually to reach a state where the paper 16 is positioned along the upper guide 67 except for the recess thereof. As a result, the distance between the paper 16 and the charge eliminating needles 65 is substantially fixed at 2.0 mm, which is the distance between the upper guide 67 other than the recess and the tips of the charge eliminating needles 65, whereby such distance between the charge eliminating needles 65 and the paper 16 is stabilized thereby exhibiting a stable charge eliminating effect.

As an electroconductivity is secured between the upper guide 67 and the charge eliminating needles 65, both members converge to the ground potential. Therefore, the upper guide 67 exerts a certain charge eliminating effect. However, the upper guide 67, being opposed to the paper 16 in a planar manner, does not easily cause a concentration of electric field. On the other hand, in the area of charge elimination by the charge eliminating needles 65, an effective charge elimination is realized by a concentration of the electric field. In this manner, the present embodiment employs charge eliminating needles for charge elimination prior to the transfer and stabilizes the distance to such charge eliminating needles, whereby a stable charge eliminating effect that cannot be realized by a transfer guide only can be attained.

Third Embodiment

Figure 4:
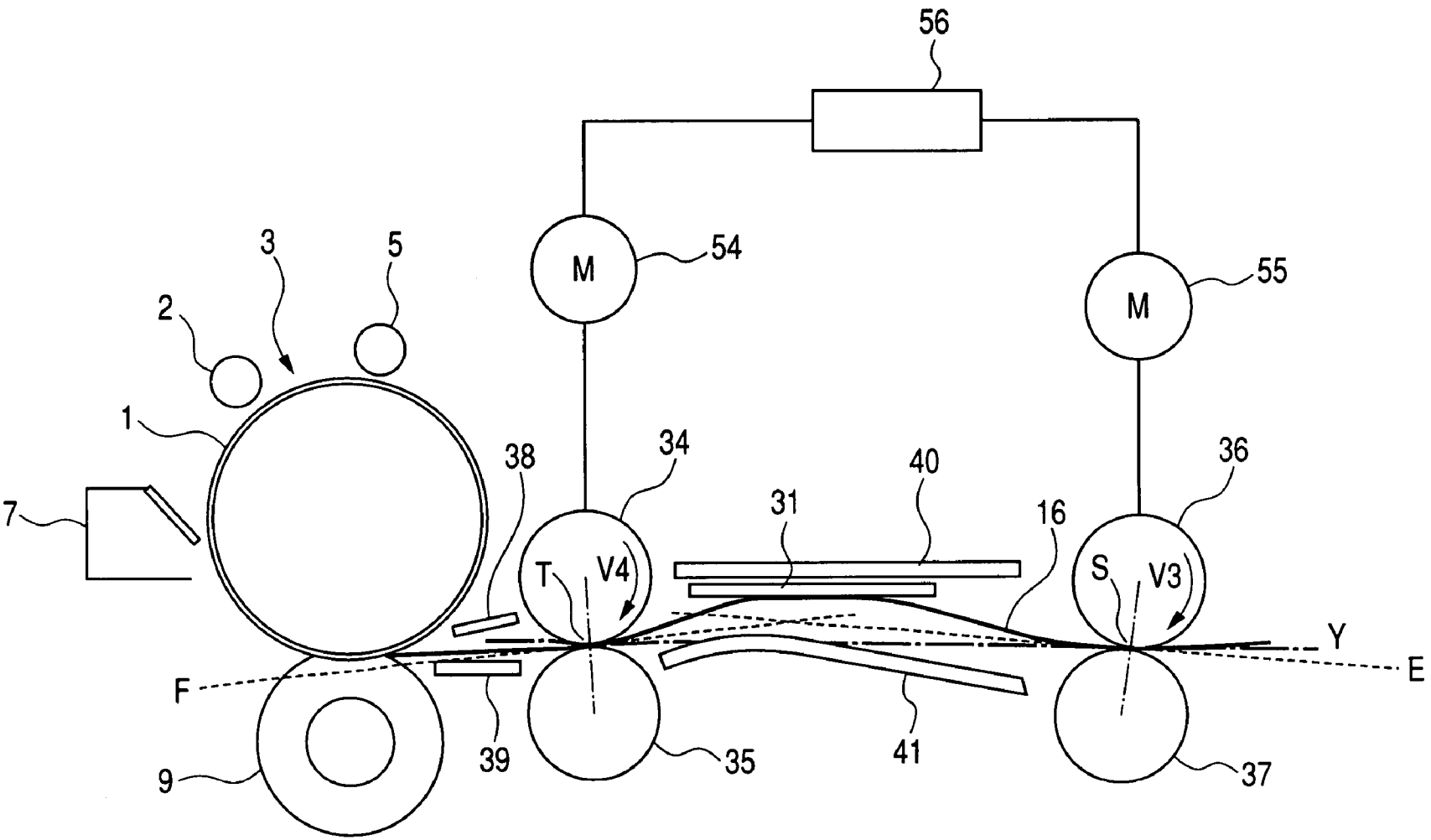
FIG. 4 is a view showing a configuration around a transfer apparatus in a third embodiment of the present invention.

FIG. 4 shows a third embodiment of the present invention. The present embodiment shows an example where the present invention is applied to an apparatus in which paired registration rollers are positioned close to a photosensitive drum.

A configuration in which the paired registration rollers are close to the photosensitive drum can maintain the paper before the transfer in a waiting state in a position close to the photosensitive drum, thereby allowing to shorten the sheet conveying path and to reduce the dimension of the apparatus. In FIG. 4, there are shown a photosensitive drum 1 serving as an image bearing member and a transfer roller 9 serving as a transfer member, which forms a transfer nip in cooperation with the photosensitive drum 1, for transferring a toner thereon onto a paper. There are also shown a paper 16, a neutralizing cloth 31 constituting charge elimination member, an upper registration roller 34 and a lower registration roller 35 which are paired as a conveying member for conveying the paper, an upper guide 38, a lower guide 39 and conveying guides 40, 41. T indicates a nip of the paired registration rollers, and S indicates a nip of the paired conveying rollers. V3 indicates a peripheral velocity of the conveying roller, and V4 indicates a peripheral velocity of the registration rollers. A line E is perpendicular to a line connecting the centers of the conveying rollers 36, 37 and tangential to the external periphery of the conveying roller. Also a line is perpendicular to a line connecting the centers of the registration rollers 34, 35 and tangential to the external periphery thereof. Components equivalent to those in the first embodiment are represented by same symbols. The photosensitive drum 1 has a peripheral velocity of 200 mm/sec. The upper registration roller 34 is formed by nickel-plated iron with an external diameter of 14 mm, and is electrically grounded. The lower registration roller is formed by an iron metal core of an external diameter of 10 mm covered by chloroprene rubber of a thickness of 2 mm, rendered conductive by dispersing carbon and having an external diameter of 14 mm. The metal core is electrically grounded.

A reference line Y connecting the registration nip T and the nip S of the conveying rollers is positioned in the following manner that the reference line Y and a line F corresponding to a nip line of the registration nip T form an angle of 10° and that, between the registration nip T and the conveying roller nip S, the line F is positioned above the reference line F, namely at the side of the neutralizing cloth 31. On the other hand, the conveying rollers 36, 37 are so positioned that a line E corresponding to a nip line of the nip S and the reference line Y form an angle of 15° and that, between the registration nip T and the conveying roller nip S, the line E positioned above the reference line Y, namely at the side of the neutralizing cloth 31.

The upper registration roller 34 and the lower registration roller 35 are rotated by a motor 54 controlled by a control apparatus 56, with a peripheral velocity V4 of 100 mm/sec. A conveying guide plate 40 is formed by a zinc-plated iron plate, and positioned higher than the registration nip T and the conveying roller nip S, and a neutralizing cloth 31 is adhered on a conveying surface. A conveying guide 41 is formed by a zinc-plated iron plate with a heaped shape. The conveying roller 36 is formed by a polyacetal resin with an external diameter of 14 mm. The conveying roller 37 is constituted of an iron metal core of an external diameter of 10 mm, covered with an insulating chloroprene rubber of a thickness of 2 mm with an external diameter of 14 mm. The conveying rollers 36, 37 are rotated by a motor 55 controlled by the control apparatus 56. The conveying roller 36 is rotated with a peripheral velocity of 104 mm/sec (V3), so that the paper is also conveyed at a speed of 104 mm/sec by the conveying rollers 36, 37.

In the following there will be explained a function of the present embodiment. The paper is conveyed by the conveying rollers 36, 37 along a broken line E, then contacts the upper registration roller 34 and reaches the registration nip T. The upper registration roller 34 and the lower registration roller 35 do not start to move immediately upon arrival of the leading end of the paper 16 but start to rotate at 10 msec after the arrival. As the conveying rollers 36, 37 continue to convey the paper even while the paired registration rollers are stopped, so that a loop is formed between the registration rollers and the conveying rollers. The loop is formed upward, namely at the side of the neutralizing cloth 31, because the nip line E of the conveying rollers 36, 37 is directed more upwards than the reference line Y between T and S, and the nip line F of the registration nip T is directed more upwards than the reference line Y between T and S. Also an upward loop formation is facilitated by a fact that a part of the conveying guide 41 is positioned higher than the nip S of the conveying rollers. The registration nip T and the conveying roller nip S are separated by a distance of 50 mm.

By starting the rotation of the paired registration rollers at 10 msec after the arrival of the leading end of the paper, there is formed a loop of about 4 mm, whereby the paper is conveyed in proximity to the neutralizing cloth 31. In this manner the paper is subjected to a charge elimination. Thereafter, the loop amount increases whereby the paper is securely contacted with the neutralizing cloth and conveyed under more stable charge elimination. After the charge elimination, the paper passes the paired registration rollers but is not frictionally charged therein because the upper registration roller 34 is made of a metal while the lower registration roller 35 has a conductive surface layer and both rollers are electrically grounded. Thereafter the paper is guided by transfer guides 38, 39 and is subjected to an image transfer.

In the present embodiment, an image defect (scattering) by a charging on the paper is not generated since the paper is subjected to a charge elimination in front of the registration rollers and is not charged by the registration rollers. Also a sheet jamming is not generated since the leading end of the paper 16 does not touch the neutralizing cloth 31 in the course of conveying. The aforementioned configuration allows to avoid a paper jamming while preventing a scattering phenomenon by a charging of the paper, even in case the registration rollers are positioned close to the photosensitive drum.

Fourth Embodiment

Figure 5:
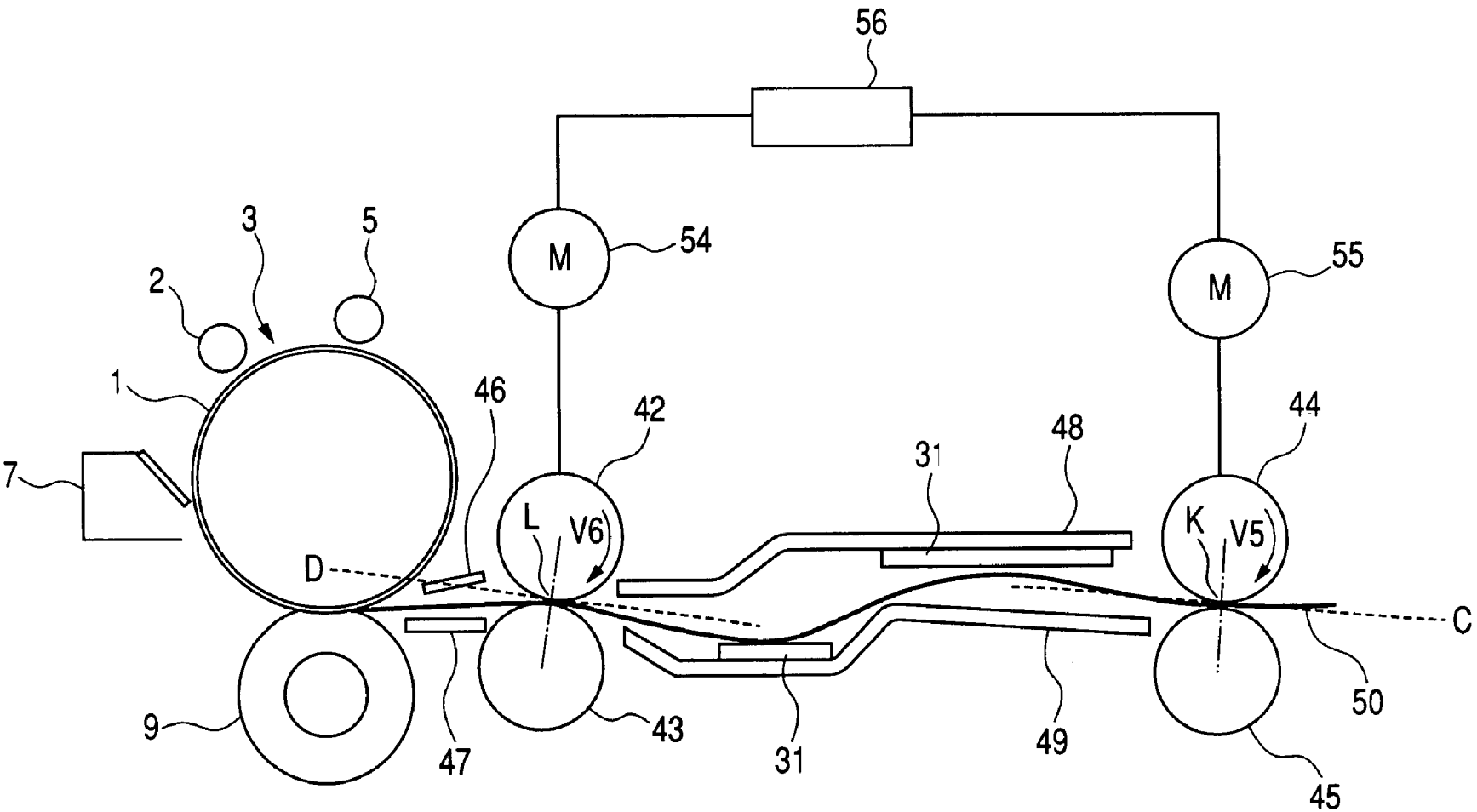
FIG. 5 is a view showing a configuration around a transfer apparatus in a fourth embodiment of the present invention.

FIG. 5 shows a fourth embodiment of the present invention.

The present embodiment explains an apparatus for printing an insulating film such as an OHP sheet as the recording material. In case of printing on paper, the charge elimination on one surface only is sufficiently effective, since a paper has small pores and charges on both surfaces can be eliminated by positioning a charge eliminating member close to a surface. On the other hand, an insulating sheet, lacking the penetrating holes, has to be charge eliminated on both surfaces. In FIG. 5, there are shown a photosensitive drum 1, a transfer roller 9, a neutralizing cloth 31, an upper registration roller 42, a lower registration roller 43, conveying rollers 44, 45, an upper guide 46, a lower guide 47, conveying guides 48, 49, and an OHP sheet 50. In FIG. 5, L indicates a nip of the paired registration rollers, and K indicates a nip of the paired conveying rollers. V5 indicates a peripheral velocity of the conveying rollers and V6 indicates a peripheral velocity of the registration rollers. A line C is perpendicular to a line connecting the centers of the conveying rollers 44, 45 and tangential to the external periphery of the conveying roller, and a line D is perpendicular to a line connecting the centers of the upper registration roller 42 and the lower registration roller 43, and tangential to the external periphery of the registration rollers. Symbols same as the foregoing indicate same components unless specified otherwise.

The photosensitive drum 1 has a peripheral velocity of 100 mm/sec. The upper registration roller 42 is formed by nickel-plated iron with an external diameter of 14 mm, and is electrically grounded. The lower registration roller 43 is formed by an iron metal core of an external diameter of 10 mm covered by chloroprene rubber of a thickness of 2 mm, rendered conductive by dispersing carbon and having an external diameter of 14 mm. The metal core is electrically grounded.

Rotation and stopping of the registration rollers are controlled by an unillustrated clutch. The upper registration roller 42 and the lower registration roller 43 have a peripheral velocity V6 of 100 mm/sec.

Conveying guide plates 48, 49 are formed by zinc-plated iron plates and constitute an S-shaped conveying path, and a neutralizing cloth 31 is adhered in a higher portion of the conveying guide 48, at a farther side from the line C. Also a neutralizing cloth 31 is adhered in a lower portion of the conveying guide 49, at a farther side from the line D. The conveying roller 44 is formed by a polyacetal resin with an external diameter of 14 mm. The conveying roller 45 is constituted of an iron metal core of an external diameter of 10 mm, covered with an insulating chloroprene rubber of a thickness of 2 mm with an external diameter of 14 mm. The conveying rollers 44, 45 have a peripheral velocity V5 of 104 mm/sec.

In the following there will be explained a function of the present embodiment.

The paper is conveyed by the conveying rollers 44, 45 along a broken line C, then along the conveying guide 49 and reaches the registration nip L through an inclined surface of the conveying guide 49 at the side of the transfer roller. As the neutralizing cloth 31 is not provided in an area where the leading end of the OHP sheet 50 passes, a jamming of the OHP sheet 50 caused by a trapping of the leading end thereof can be avoided. The upper registration roller 42 and the lower registration roller 43 do not start to move immediately upon arrival of the leading end of the OHP sheet 50 but start to rotate at 20 msec after the arrival. As the conveying rollers 44, 45 continue to convey the OHP sheet while the paired registration rollers are stopped, so that a loop is formed between the registration rollers and the conveying rollers. The loop is developed into an S-shape as it is defined in shape between the conveying guides 48, 49. Such S-shaped loop becomes convex in portions where the neutralizing cloths are provided, in which the OHP sheet 50 approaches the neutralizing cloth. The conveying guides 48, 49 have a spacing of 4 mm, and the registration nip L and the conveying roller nip K have a distance of 70 mm. By starting the rotation of the paired registration rollers at 20 msec after the arrival of the leading end of the OHP sheet, there is formed a loop of about 4 mm, whereby the OHP sheet 50 is conveyed in proximity to the neutralizing cloths 31. In this manner the OHP sheet 50 is subjected to a charge elimination.

After the charge elimination, the OHP sheet passes the paired registration rollers but is not frictionally charged therein because the upper registration roller 42 is made of a metal while the lower registration roller 43 has a conductive surface layer and both rollers are electrically grounded. Thereafter the OHP sheet is guided by transfer guides 46, 47 and is subjected to an image transfer.

In the present embodiment, an image defect (scattering) by a charging on the OHP sheet is not generated since the OHP sheet 50 is subjected to a charge elimination on both surfaces in front of the registration rollers and is not charged by the registration rollers. Also a sheet jamming is not generated since the leading end of the OHP sheet 50 does not touch the neutralizing cloths 31 in the course of conveying. The aforementioned configuration allows to prevent a scattering phenomenon by a charging, even in case of an image formation on an insulating sheet such as an OHP sheet.

Fifth Embodiment

Figure 6:
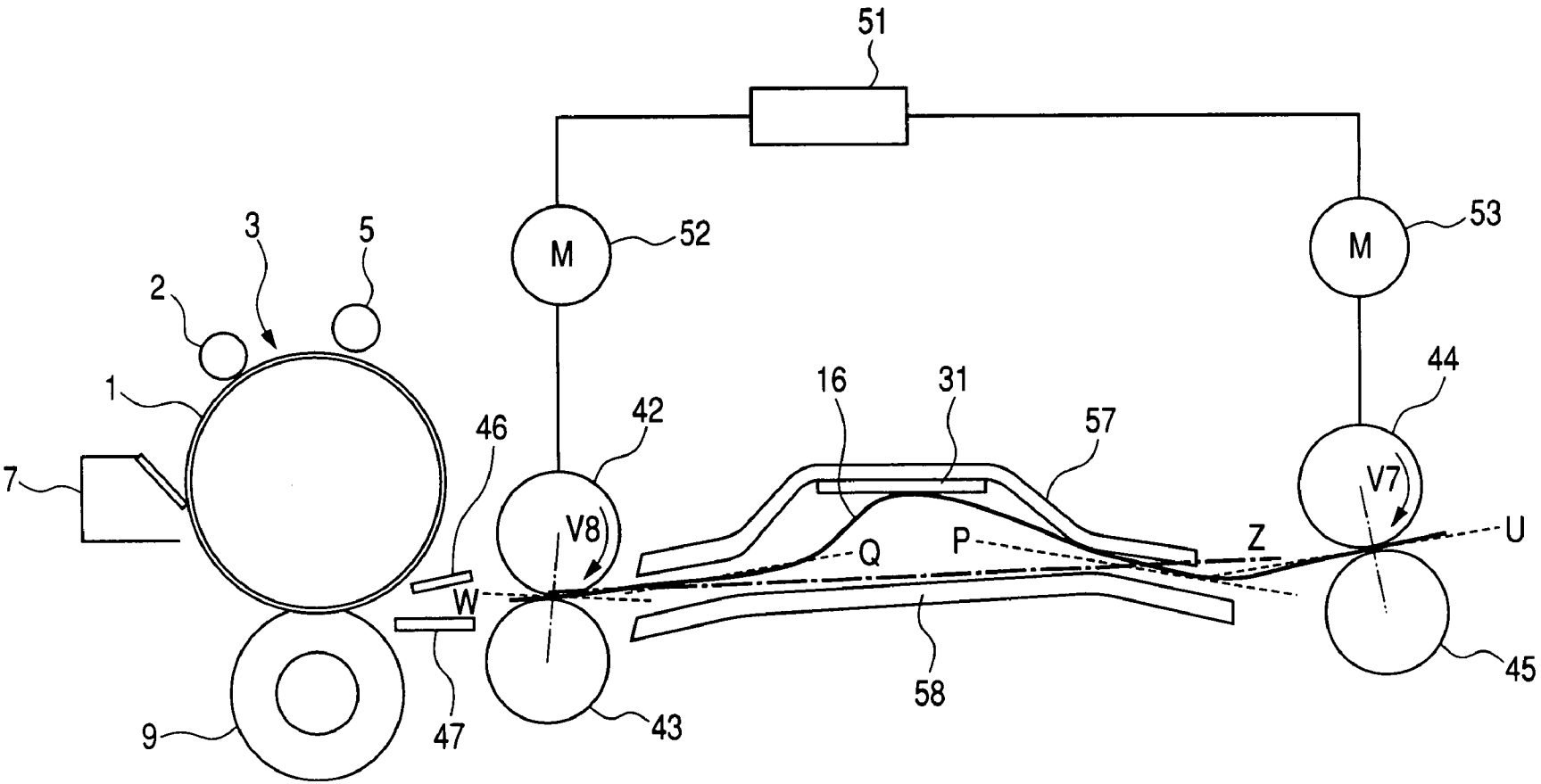
FIG. 6 is a view showing a configuration around a transfer apparatus in a fifth embodiment of the present invention.
Figure 7:
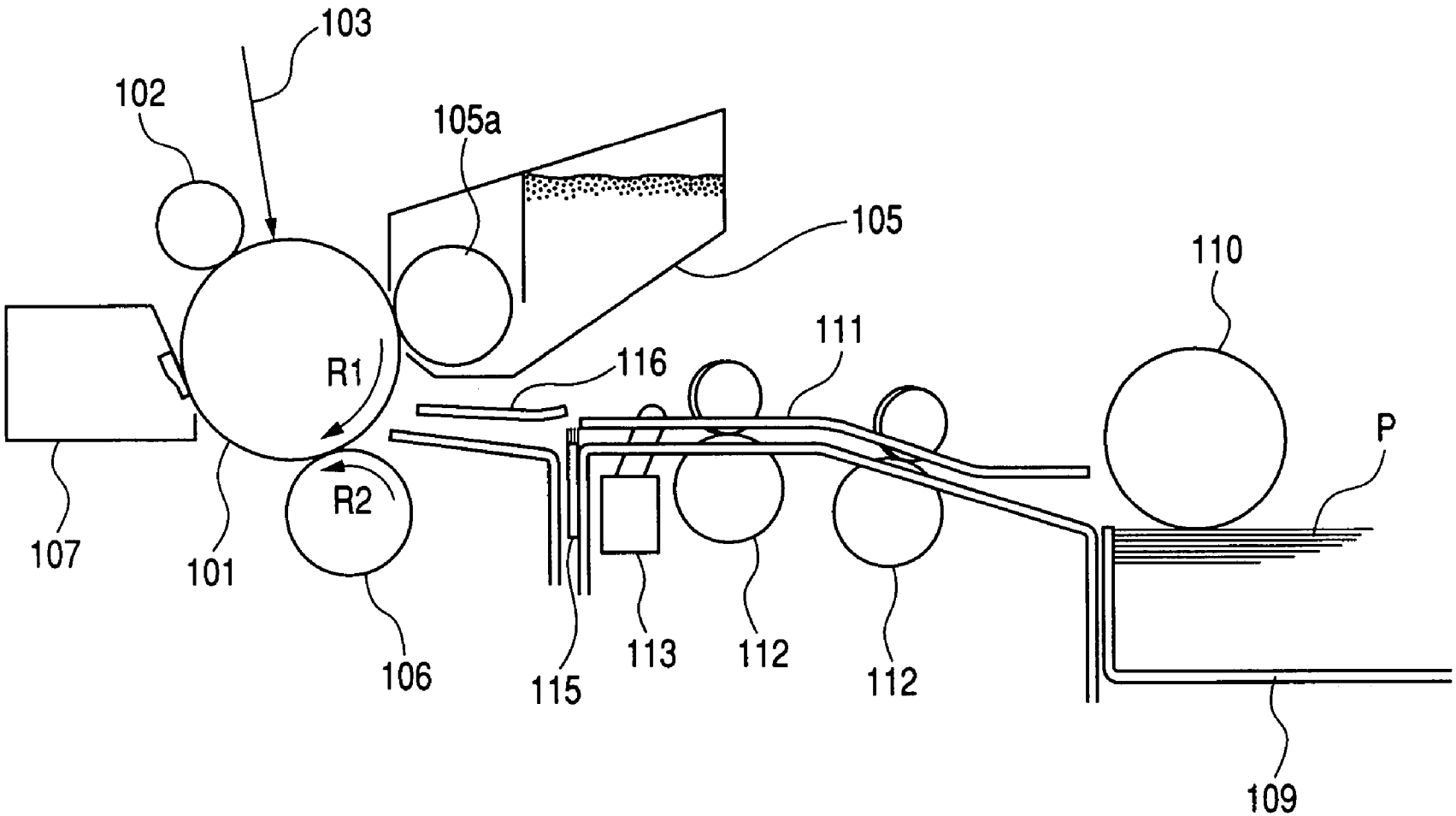
FIG. 7 is a view showing a prior image forming apparatus.

FIG. 6 shows a fifth embodiment of the present invention.

The present embodiment provides a configuration in which a loop is formed in a paper prior to the transfer, by guide members. Components equivalent in function to those in the foregoing third embodiment will be represented by corresponding numbers. In FIG. 6, there are shown a photosensitive drum 1, a transfer roller 9, a neutralizing cloth 31, an upper registration roller 59, a lower registration roller 60, conveying rollers 61, 62, an upper guide 46, a lower guide 47, conveying guides 57, 58 serving as member for restricting conveying of a paper, and a paper 16.

In FIG. 6, V7 indicates a peripheral velocity of the conveying rollers, and V8 indicates a peripheral velocity of the registration rollers. A line U is perpendicular to a line connecting the centers of the conveying rollers 44, 45 and tangential to an external periphery of the conveying rollers. A line W is perpendicular to a line connecting the centers of the registration rollers 42, 43 and tangential to an external periphery of the registration rollers. Symbols same as the foregoing indicate same components.

The photosensitive drum 1 has a peripheral velocity of 100 mm/sec. The upper registration roller 42 is formed by nickel-plated iron with an external diameter of 14 mm, and is electrically grounded. The lower registration roller 43 is formed by an iron metal core of an external diameter of 10 mm covered by chloroprene rubber of a thickness of 2 mm, rendered conductive by dispersing carbon and having an external diameter of 14 mm. The metal core is electrically grounded.

Rotation and stopping of the registration rollers are controlled by an unillustrated clutch. The upper registration roller 42 and the lower registration roller 43 have a peripheral velocity V8 of 100 mm/sec.

Conveying guide plates 57, 58 are formed by zinc-plated iron plates and constitute a conveying path having a room for loop formation above the paper. The conveying roller 44 is formed by a polyacetal resin with an external diameter of 14 mm. The conveying roller 45 is constituted of an iron metal core of an external diameter of 10 mm, covered with an insulating chloroprene rubber of a thickness of 2 mm with an external diameter of 14 mm. The conveying rollers 44, 45 have a peripheral velocity V5 of 104 mm/sec.

In the following there will be explained a function of the present embodiment. The paper is conveyed by the conveying rollers 44, 45 along a broken line U, then, upon entering a gap between the conveying guides 57 and 58, is restricted in the proceeding direction by the conveying guides 57 and 58, and conveyed along a broken line P. Thereafter the paper passes an inclined face of the conveying guide 57 at the side of the upper registration roller 42 and reaches a nip between the upper registration roller 42 and the lower registration roller 43. As the neutralizing cloth 31 is not provided in an area where the leading end of the paper 16 passes, a jamming of the paper 16 caused by a trapping of the leading end thereof can be avoided. The upper registration roller 42 and the lower registration roller 43 do not start to move immediately upon arrival of the leading end of the paper 16 but start to rotate at 20 msec after the arrival. As the conveying rollers 44, 45 continue to convey the paper 16 while the paired registration rollers are stopped, so that a loop is formed between the registration rollers 42, 43 and the conveying rollers 44, 45. The loop is assumes a convex form to the above in a space between the conveying guides 48, 49, so as to approach the neutralizing cloth 31, as broken lines P and Q have upward directed vectors.

Such loop becomes convex in a portion where the neutralizing cloth is provided, in which the paper 16 approaches the neutralizing cloth. By starting the rotation of the paired registration rollers at 20 msec after the arrival of the leading end of the paper, there is formed a loop of about 4 mm, whereby the paper 16 is conveyed in proximity to the neutralizing cloth 31. In this manner the paper 16 is subjected to a stable charge elimination.

After the charge elimination by the neutralizing cloth, the paper 16 passes the paired registration rollers but is not frictionally charged therein because the upper registration roller 42 is made of a metal while the lower registration roller 43 has a conductive surface layer and both rollers are electrically grounded. Thereafter the paper 16 is guided by transfer guides 46, 47 and is subjected to an image transfer.

As the transfer is executed on the paper which is sufficiently charge eliminated by the neutralizing cloth 31, there can be obtained a clear image output without an image scattering. Also, as the leading end of the paper does not touch the neutralizing cloth, there can be avoided a sheet jamming caused by the leading end of the paper caught by the charge elimination member.

The foregoing embodiments have been explained by a printer as an example of an image forming apparatus, but the present invention is not limited to such case. The present invention is applicable also to another image forming apparatus such as a copying apparatus or a facsimile, or a composite apparatus in which such functions are combined, and similar effects can be obtained by applying the present invention to such image forming apparatus.

Also the present invention has been explained by various embodiments, but the concept and the range of the present invention are not restricted to particular descriptions and drawings in the specification. As an example, the present invention is naturally applicable to a case of transfer from an intermediate transfer member to a paper or the like.

This application claims priority from Japanese Patent Application No. 2004-065878 filed Mar. 9, 2004, which is hereby incorporated by reference herein.

What is claimed is:

1. An image forming apparatus comprising:

an image bearing member for bearing a toner;

a first conveyance member which conveys a recording material;

a second conveyance member which forms a transfer nip with said image bearing member and conveys a recording material, said second conveyance member being provided downstream of said first conveyance member in a conveyance direction of the recording material; and a charge elimination member which is provided between said first conveyance member and said second conveyance member to eliminate charges on the recording material;

wherein a toner image on said image bearing member is transferred at the transfer nip, wherein said charge elimination member provided apart from a line on which a leading edge of the recording material moves and faces a conveyance path of the recording material, wherein a conveyance speed of the recording material by said first conveyance member is faster than a conveyance speed of the recording material by said second conveyance member, whereby a loop of the recording material conveyed by said first conveyance member is enlarged so that the recording material comes close to said charge elimination member.

2. An image forming apparatus according to claim 1, wherein a part of the recording material contacts said charge elimination member and a leading edge of a recording material in the conveyance direction of the recording material does not contact said charge elimination member.

3. An image forming apparatus according to claim 1, wherein the recording material does not contact said charge elimination member until the recording material contacts said second conveyance member.

4. An image forming apparatus according to claim 3, wherein as the recording material is conveyed by both a first conveyance member and a second conveyance member, the recording material contacts said charge elimination member.

5. An image forming apparatus according to claim 1, wherein the recording material is conveyed by both a first conveyance member and a second conveyance member, and the recording material contacts said charge elimination member.

6. An image forming apparatus according to claim 1, wherein said charge elimination member is a neutralizing cloth.

7. An image forming apparatus according to claim 1, wherein said charge elimination member is a charge eliminating needle.

8. An image forming apparatus comprising:

an image bearing member for bearing a toner;

a first conveyance member which conveys a recording material;

a second conveyance member which forms a transfer nip with said image bearing member and conveys a recording material, said second conveyance member being provided downstream of said first conveyance member in a conveyance direction of the recording material; and a charge elimination member which is provided between said first conveyance member and said second conveyance member to eliminate charges on the recording material;

wherein a toner image on said image bearing member is transferred at the transfer nip, wherein said charge elimination member is provided apart from a line on which a leading edge of the recording material moves and faces a conveyance path of the recording material, and wherein said second conveyance member does not start conveying a recording material until a predetermined time period passes after a leading edge of a recording material conveyed by said first conveyance member contacts said second conveyance member, whereby a loop of the recording material conveyed by said first conveyance member is enlarged so that the recording material comes close to said charge elimination member.

9. An image forming apparatus according to claim 8, wherein a part of the recording material contacts said charge elimination member and a leading edge of a recording material in the conveyance direction of the recording material does not contacts said charge elimination member.

10. An image forming apparatus according to claim 8, wherein the recording material does not contact said charge elimination member until the recording material contacts said second conveyance member.

11. An image forming apparatus according to claim 10, wherein during the recording material is conveyed by both a first conveyance member and a second conveyance member, the recording material contacts said charge elimination member.

12. An image forming apparatus according to claim 8, wherein said charge elimination member is provided to face a surface on which toner of the recording material is transferred.

13. An image forming apparatus according to claim 8, wherein said charge elimination member is a neutralizing cloth.

14. An image forming apparatus according to claim 8, wherein said charge elimination member is a charge eliminating needle.

15. An image forming apparatus including:

an image bearing member for bearing a toner;

a first conveyance member which conveys a recording material;

a second conveyance member which conveys a recording material, said second conveyance member being provided downstream of said first conveyance member in a conveyance direction of the recording material;

a transfer member which transfers a toner image from said image bearing member onto the recording material;

a charge elimination member which is provided between said first conveyance member and said second conveyance member to eliminate charges on the recording material;

wherein said charge elimination member is provided apart from a line on which a leading edge of the recording material moves and faces a conveyance path of the recording material, wherein a conveyance speed of the recording material by said first conveyance member is faster than a conveyance speed of the recording material by said second conveyance member, whereby a loop of the recording material conveyed by said first conveyance member is enlarged so that the recording material comes close to charge elimination member.

16. An image forming apparatus according to claim 15, wherein a part of the recording material contacts said charge elimination member and a leading edge of a recording material in the conveyance direction of the recording material does not contacts said charge elimination member.

17. An image forming apparatus according to claim 15, wherein the recording material does not contact said charge elimination member until the recording material contacts said second conveyance member.

18. An image forming apparatus according to claim 17, wherein during the recording material is conveyed by both a first conveyance member and a second conveyance member, the recording material contacts said charge elimination member.

19. An image forming apparatus according to claim 15, wherein said charge elimination member is provided to face a surface on which toner of the recording material is transferred.

20. An image forming apparatus according to claim 15, wherein said charge elimination member is a neutralizing cloth.

21. An image forming apparatus according to claim 15, wherein said charge elimination member is a charge eliminating needle.

22. An image forming apparatus comprising:

an image bearing member for bearing a toner;

a first conveyance member which conveys a recording material;

a second conveyance member which conveys a recording material, said second conveyance member being provided downstream of said second conveyance member in a conveyance direction of the recording material;

a transfer member which transfers a toner image from said image bearing member onto recording material; and a charge elimination member which is provided between said first conveyance member and said second conveyance member to eliminate charges on the recording material, wherein said charge elimination member is provided apart from a line on which a leading edge of the recording material moves and faces a conveyance path of the recording material, and wherein said second conveyance member does not start conveying a recording material until a predetermined time period passes after a leading edge of a recording material conveyed by said first conveyance member contacts said second conveyance member, whereby a loop of the recording material conveyed by said first conveyance member becomes larger so that the recording material comes close to said charge elimination member.

23. An image forming apparatus according to claim 22, wherein a part of the recording material contacts said charge elimination member and a leading edge of a recording material in the conveyance direction of the recording material does not contacts said charge elimination member.

24. An image forming apparatus according to claim 22, wherein the recording material does not contact said charge elimination member until the recording material contacts said second conveyance member.

25. An image forming apparatus according to claim 24, wherein during the recording material is conveyed by both a first conveyance member and a second conveyance member, the recording material contacts said charge elimination member.

26. An image forming apparatus according to claim 22, wherein said charge elimination member is provided to face a surface on which toner of the recording material is transferred.

27. An image forming apparatus according to claim 22, wherein said charge elimination member is a neutralizing cloth.

28. An image forming apparatus according to claim 22, wherein said charge elimination member is a charge eliminating needle.

* * * * *

UNITED STATES PATENT AND TRADEMARK OFFICE

CERTIFICATE OF CORRECTION

PATENT NO. : 7,280,798 B2
APPLICATION NO. : 11/071320
DATED : October 9, 2007
INVENTOR(S) : Takayasu Yuminamochi It is certified that error appears in the above-identified patent and that said Letters Patent is hereby corrected as shown below:

COLUMN 1:
Line 29, “transfer” should read --transfers--.

COLUMN 2:
Line 17, “contact” should read --contacts--.
Line 35, “of” should read --object of--.

COLUMN 4:
Line 54, “crashing” should read --crushing--.

COLUMN 6:
Line 15, “the both” should read --both--.

COLUMN 10:
Line 8, “line E” should read --line E is--.
Line 35, “As the” should read --The--.

COLUMN 12:
Line 9, “As the” should read --The--.

COLUMN 13:
Line 35, “As the” should read --The--.
Line 39, “is” should be deleted.

COLUMN 15:
Line 33, “contacts” should read --contact--.
Line 39, “during” should read --while--.

UNITED STATES PATENT AND TRADEMARK OFFICE

CERTIFICATE OF CORRECTION

PATENT NO. : 7,280,798 B2
APPLICATION NO. : 11/071320
DATED : October 9, 2007
INVENTOR(S) : Takayasu Yuminamochi It is certified that error appears in the above-identified patent and that said Letters Patent is hereby corrected as shown below:

COLUMN 16:
Line 16, “contacts” should read --contact--.
Line 22, “during” should read --while--.

COLUMN 17:
Line 2, “contacts” should read --contact--.

Signed and Sealed this

Twenty-seventh Day of May, 2008

JON W. DUDAS
*Director of the United States Patent and Trademark Office*